US008909115B2

(12) United States Patent
Suzuki et al.

(10) Patent No.: US 8,909,115 B2
(45) Date of Patent: Dec. 9, 2014

(54) FIXING DEVICE HAVING MEMBERS TO RESTRICT END FACES OF TUBULAR MEMBER

(75) Inventors: Noboru Suzuki, Komaki (JP); Kei Ishida, Nagoya (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 106 days.

(21) Appl. No.: 13/426,816

(22) Filed: Mar. 22, 2012

(65) Prior Publication Data

US 2012/0308275 A1 Dec. 6, 2012

(30) Foreign Application Priority Data

May 31, 2011 (JP) ..... 2011-122861

(51) Int. Cl.
*G03G 15/20* (2006.01)

(52) U.S. Cl.
CPC ..... *G03G 15/2017* (2013.01); *G03G 15/2064* (2013.01); *G03G 15/2053* (2013.01); *G03G 2215/2016* (2013.01); *G03G 2215/2035* (2013.01)
USPC ..... 399/329; 219/216

(58) Field of Classification Search
CPC ..... G03G 15/2017
USPC ..... 399/329
See application file for complete search history.

(56) References Cited

U.S. PATENT DOCUMENTS

| | | | | |
|---|---|---|---|---|
| 5,742,878 | A | 4/1998 | Kuroda | |
| 5,828,035 | A * | 10/1998 | Kuroda | 219/216 |
| 6,014,539 | A | 1/2000 | Sano et al. | |
| 7,209,696 | B2 | 4/2007 | Umezawa et al. | |
| 7,235,761 | B1 * | 6/2007 | Maul et al. | 219/216 |
| 7,242,895 | B2 * | 7/2007 | Inada et al. | 399/328 |

(Continued)

FOREIGN PATENT DOCUMENTS

| | | |
|---|---|---|
| JP | 06-003982 | 1/1994 |
| JP | 08-006409 | 1/1996 |

(Continued)

OTHER PUBLICATIONS

Co-pending U.S. Appl. No. 13/426,878, filed Mar. 22, 2012.

(Continued)

*Primary Examiner* — David Gray
*Assistant Examiner* — Geoffrey Evans
(74) *Attorney, Agent, or Firm* — Banner & Witcoff, Ltd.

(57) ABSTRACT

A fixing device for thermally fixing a developing agent image to a sheet includes: a flexible tubular member having an inner peripheral surface, the tubular member defining an axis extending in an axial direction and having widthwise end portions in the axial direction; a heater; a nip member being in sliding contact with the inner peripheral surface; a backup member confronting the nip member to nip the tubular member in cooperation with the nip member; a stay supporting the nip member; a pair of inner guides being in sliding contact with the inner peripheral surface to guide the same; and a pair of restricting members restricting the widthwise end portions of the tubular member from moving in the axial direction, at least one of the pair of restricting members being formed separately from the inner guides and being assembled to the stay in a direction perpendicular to the axial direction.

21 Claims, 6 Drawing Sheets

(56) References Cited

U.S. PATENT DOCUMENTS

| | | | | |
|---|---|---|---|---|
| 7,294,810 | B1 * | 11/2007 | Haseba et al. | 219/216 |
| 7,792,476 | B2 * | 9/2010 | Seol et al. | 399/329 |
| 7,881,650 | B2 * | 2/2011 | Shin et al. | 399/329 |
| 8,032,069 | B2 * | 10/2011 | Shin et al. | 399/329 |
| 8,135,323 | B2 * | 3/2012 | Suzuki et al. | 399/329 |
| 8,385,801 | B2 * | 2/2013 | Sugaya | 399/329 |
| 8,452,218 | B2 * | 5/2013 | Fujiwara et al. | 399/329 |
| 8,509,667 | B2 * | 8/2013 | Miyauchi | 399/329 |
| 8,559,862 | B2 * | 10/2013 | Kondo et al. | 399/329 |
| 8,611,802 | B2 * | 12/2013 | Suzuki et al. | 399/329 |
| 8,725,038 | B2 * | 5/2014 | Yamaguchi et al. | 399/122 |
| RE45,015 | E * | 7/2014 | Uchida et al. | 399/329 |
| 2005/0089787 | A1 | 4/2005 | Uchinokura et al. | |
| 2005/0163540 | A1 | 7/2005 | Umezawa et al. | |
| 2006/0133868 | A1 * | 6/2006 | Kobayashi et al. | 399/328 |
| 2006/0233575 | A1 * | 10/2006 | Uchida et al. | 399/329 |
| 2008/0056783 | A1 * | 3/2008 | Yamamoto et al. | 399/329 |
| 2008/0232870 | A1 * | 9/2008 | Ardery et al. | 399/329 |
| 2009/0092423 | A1 * | 4/2009 | Shin et al. | 399/329 |
| 2009/0142113 | A1 | 6/2009 | Kajita et al. | |
| 2009/0208264 | A1 | 8/2009 | Fujiwara et al. | |
| 2009/0257794 | A1 | 10/2009 | Kaino et al. | |
| 2011/0058862 | A1 | 3/2011 | Yamaguchi et al. | |
| 2011/0058864 | A1 | 3/2011 | Fujimoto et al. | |
| 2011/0129267 | A1 * | 6/2011 | Arimoto et al. | 399/329 |
| 2011/0164905 | A1 * | 7/2011 | Kondo et al. | 399/328 |
| 2011/0164906 | A1 | 7/2011 | Ishida et al. | |
| 2011/0170919 | A1 * | 7/2011 | Fujiwara et al. | 399/331 |
| 2011/0170920 | A1 * | 7/2011 | Fujiwara et al. | 399/331 |
| 2011/0188908 | A1 * | 8/2011 | Ishida et al. | 399/330 |
| 2011/0194882 | A1 | 8/2011 | Kitano et al. | |
| 2011/0206406 | A1 | 8/2011 | Suzuki et al. | |
| 2011/0211881 | A1 * | 9/2011 | Suzuki et al. | 399/329 |
| 2011/0211882 | A1 * | 9/2011 | Suzuki et al. | 399/329 |
| 2011/0318074 | A1 | 12/2011 | Hiramatsu | |
| 2012/0163882 | A1 | 6/2012 | Kim et al. | |
| 2012/0163885 | A1 * | 6/2012 | Ishida | 399/329 |
| 2012/0251138 | A1 | 10/2012 | Ishida et al. | |
| 2012/0251207 | A1 | 10/2012 | Ishida et al. | |
| 2012/0269562 | A1 * | 10/2012 | Hashimoto | 399/338 |
| 2013/0315640 | A1 * | 11/2013 | Miyauchi | 399/336 |
| 2013/0322937 | A1 * | 12/2013 | Suzuki et al. | 399/329 |
| 2013/0322939 | A1 * | 12/2013 | Ishida et al. | 399/329 |

FOREIGN PATENT DOCUMENTS

| | | |
|---|---|---|
| JP | 09-127809 | 5/1997 |
| JP | 10-247026 | 9/1998 |
| JP | 2001-147605 | 5/2001 |
| JP | 2001-356623 | 12/2001 |
| JP | 2005-166299 | 6/2005 |
| JP | 2006-047769 | 2/2006 |
| JP | 2008-233886 | 10/2008 |
| JP | 2009-053507 | 3/2009 |
| JP | 2011-170239 | 9/2011 |

OTHER PUBLICATIONS

Co-pending U.S. Appl. No. 13/426,944, filed Mar. 22, 2012.

Co-pending U.S. Appl. No. 13/426,784, filed Mar. 22, 2012.

Notice of Allowance issued in U.S. Appl. No. 13/426,878 mailed Apr. 17, 2014.

Non-Final Office Action received in corresponding U.S. Appl. No. 13/426,784 mailed Jun. 5, 2014.

Non-Final Office Action received in corresponding U.S. Appl. No. 13/426,944 mailed Jun. 5, 2014.

Office Action issued in corresponding U.S. Appl. No. 13/426,878 mailed Oct. 1, 2013.

* cited by examiner

FIXING DEVICE HAVING MEMBERS TO RESTRICT END FACES OF TUBULAR MEMBER

CROSS REFERENCE TO RELATED APPLICATION

This application claims priority from Japanese Patent Application No. 2011-122861 filed May 31, 2011. The entire content of the priority application is incorporated herein by reference.

TECHNICAL FIELD

The present invention relates to a fixing device that thermally fixes a transferred developing agent image to a sheet.

BACKGROUND

A conventional thermal fixing device used in an electrophotographic image forming apparatus includes an endless fixing belt that circularly moves, a heater disposed at an internal space defined by an inner peripheral surface of the fixing belt, a backup roller, a heating plate (nip plate) that nips the fixing belt in cooperation with the backup member to provide a nip region, and a guide member for guiding the circular movement of the fixing belt. Specifically, the guide member is configured of an inner guide for guiding the inner peripheral surface of the fixing belt, and an end-face restricting member for restricting a position of the fixing belt (position of an end face of the fixing belt) in an axial direction of the fixing belt. In this fixing device, the end face restricting member is inserted into and assembled to the inner guide in the axial direction after the fixing belt is assembled.

SUMMARY

In the above-described fixing device, the end-face restricting member may abut on the end portion of the fixing belt at the time of assembly, possibly causing the fixing belt to be damaged.

In view of the foregoing, it is an object of the present invention to provide a fixing device having an end-face restricting member capable of suppressing a fixing belt from being damaged at the time of assembly.

In order to attain the above and other objects, there is provided a fixing device for thermally fixing a developing agent image to a sheet. The fixing device includes a flexible tubular member having an inner peripheral surface defining an internal space, a heater disposed at the internal space, a nip member, a backup member, a stay, a pair of inner guides and a pair of restricting members. The flexible tubular member is circularly movable while the developing agent image is thermally fixed, the flexible tubular member defining an axis extending in an axial direction and having widthwise end portions in the axial direction. The nip member is disposed at the internal space and configured to be in sliding contact with the inner peripheral surface of the flexible tubular member. The backup member is disposed to confront the nip member to nip the flexible tubular member in cooperation with the nip member. The stay is disposed at the internal space to support the nip member. The pair of inner guides is configured to be in sliding contact with the inner peripheral surface of the flexible tubular member to guide the inner peripheral surface of the flexible tubular member while the flexible tubular member circularly moves. The pair of restricting members is configured to restrict the widthwise end portions of the flexible tubular member from moving in the axial direction, at least one of the pair of restricting members being formed separately from the inner guides and being assembled to the stay in a first direction perpendicular to the axial direction.

DETAILED DESCRIPTION

First, a general configuration of a laser printer 1 incorporating a fixing device 100 according to an embodiment of the present invention will be described with reference to FIG. 1. In the following description, a general structure of the laser printer 1 will be described first and a detailed structure of the fixing device 100 will be then described.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side of the laser printer 1 are referred to as a front side, a rear side, a left side and a right side, respectively.

Figure 1:
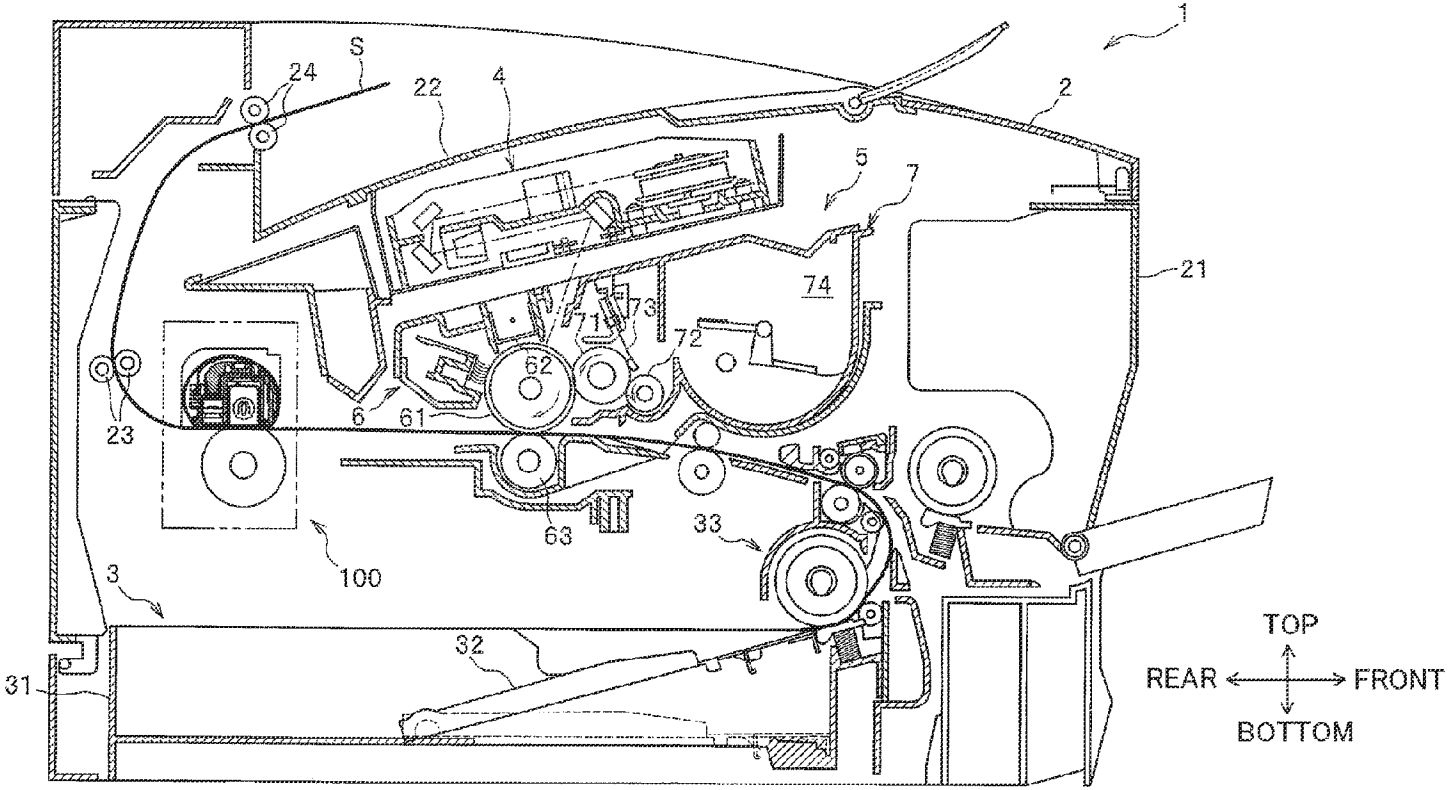
FIG. 1 is a schematic cross-sectional view illustrating a general configuration of a laser printer provided with a fixing device according to an embodiment of the present invention.

As shown in FIG. 1, the laser printer 1 includes a main frame 2 provided with a movable front cover 21. Within the main frame 2, a sheet supply unit 3 for supplying a sheet S, an exposure unit 4, a process cartridge 5 for transferring a toner image (developing agent image) on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31 for accommodating the sheet S, a lifter plate 32 for lifting up a front side of the sheet S, a sheet conveying mechanism 33. Each sheet S accommodated in the sheet supply tray 31 is lifted upward by the lifter plate 32, and is conveyed toward the process cartridge 5 by the sheet conveying mechanism 33.

The exposure unit 4 is disposed at an upper portion of the main frame 2. The exposure unit 4 includes a laser emission unit (not shown), a polygon mirror, lenses and reflection mirrors (shown without reference numerals). In the exposure unit 4, the laser emission unit emits a laser beam (indicated by a chain line in FIG. 1) based on image data such that a surface of a photosensitive drum 61 (described later) is exposed by high speed scanning of the laser beam.

The process cartridge 5 is disposed below the exposure unit 4. The process cartridge 5 is detachably loadable in the main frame 2 through an opening defined when the front cover 21 of the main frame 2 is opened. The process cartridge 5 includes a drum unit 6 and a developing unit 7.

The drum unit 6 includes the photosensitive drum 61, a charger 62, and a transfer roller 63. The developing unit 7 is detachably mounted on the drum unit 6. The developing unit 7 includes a developing roller 71, a supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to the high speed scanning of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 to be carried on the developing roller 71 as a thin layer having a uniform thickness.

The toner borne on the developing roller 71 is supplied to the electrostatic latent image formed on the photosensitive drum 61, thereby developing the electrostatic latent image into a visible toner image. The toner image is thus formed on the surface of the photosensitive drum 61. Subsequently, when the sheet S is conveyed between the photosensitive drum 61 and the transfer roller 63, the toner image formed on the photosensitive drum 61 is transferred onto the sheet S.

The fixing device 100 is disposed rearward of the process cartridge 5. The toner image (toner) transferred onto the sheet S is thermally fixed on the sheet S while the sheet S passes through the fixing device 100. The sheet S on which the toner image has been thermally fixed is then conveyed by conveying rollers 23, 24 to be discharged onto a discharge tray 22 formed on an upper surface of the main frame 2.

Next, a detailed structure of the fixing device 100 according to the embodiment of the present invention will be described with reference to FIGS. 2 through 6B.

Figure 2:
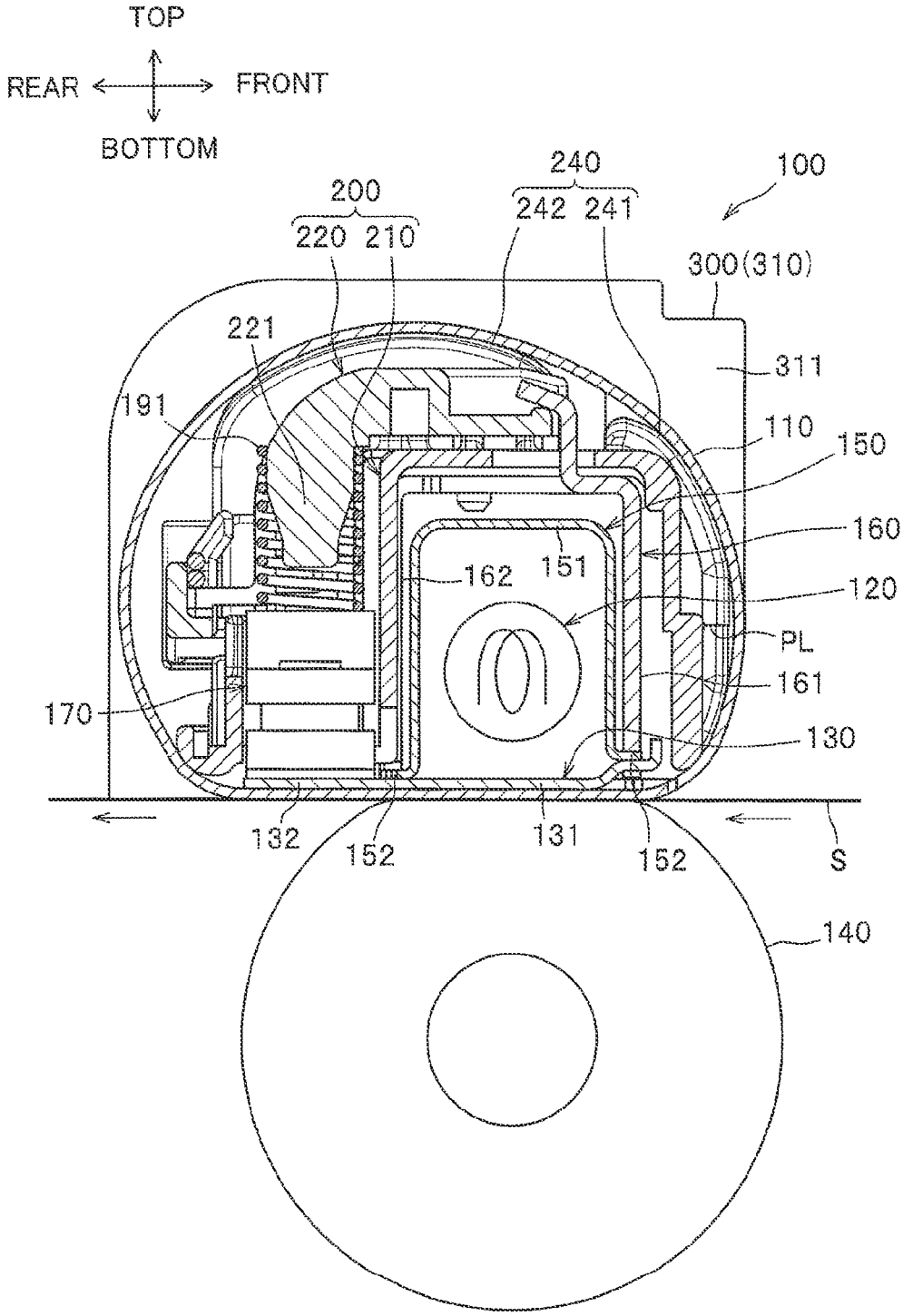
FIG. 2 is a schematic cross-sectional view of the fixing device according to the embodiment taken along a plane in which a thermostat of the fixing device is included.
Figure 3:
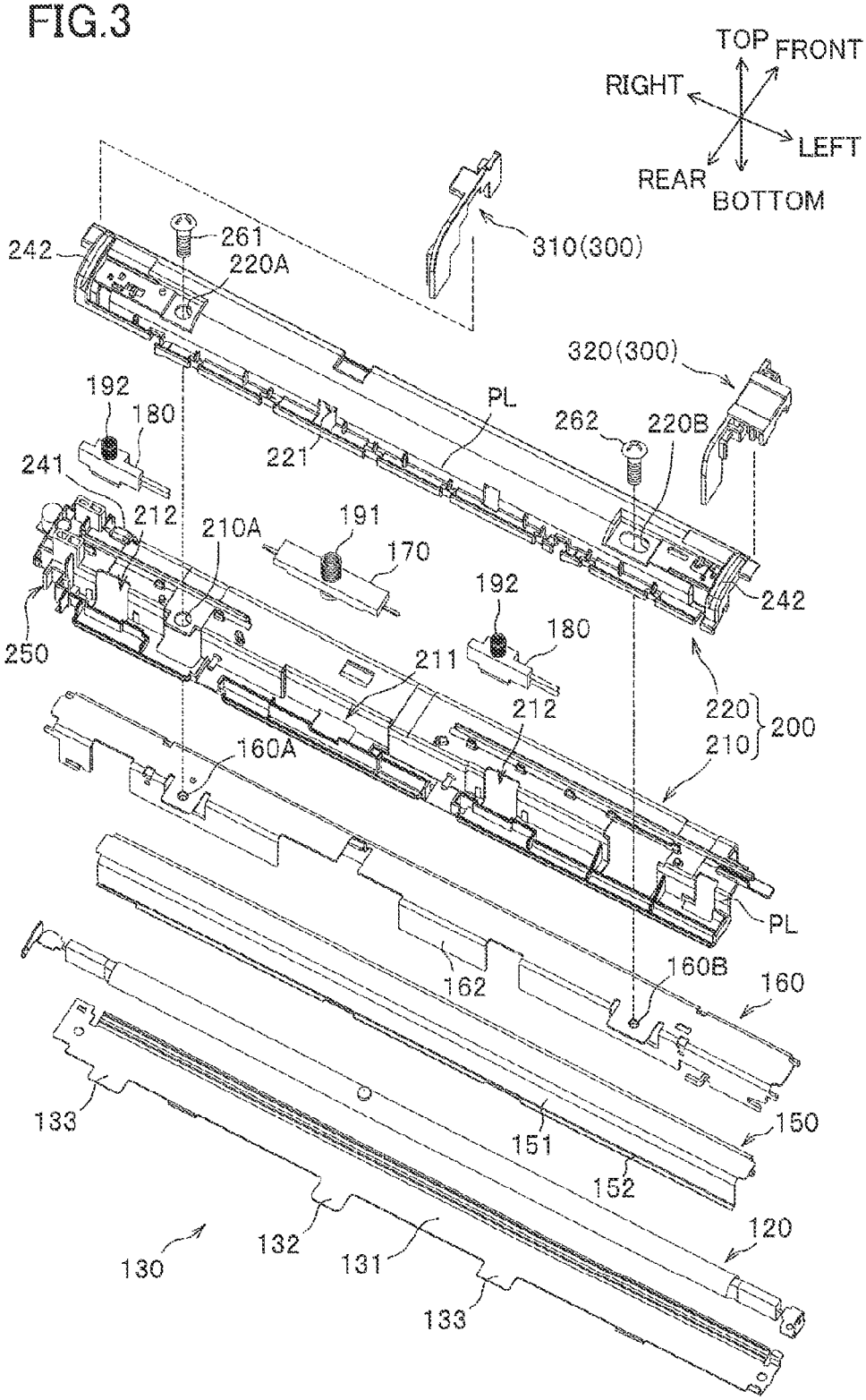
FIG. 3 is an exploded perspective view of the fixing device according to the embodiment, the fixing device including a nip plate, a halogen lamp, a reflection member, a stay, a cover assembly, the thermostat, two thermistors, coil springs, a first end-face restricting member and a second end-face restricting member.

As shown in FIG. 2, the fixing device 100 includes a flexible fusing belt 110 as a tubular member, a halogen lamp 120 as a heater, a nip plate 130 as a nip member, a backup roller 140 as a backup member, a reflection member 150, a stay 160, a thermostat 170 and two thermistors 180 (see FIG. 3), a cover assembly 200, a pair of end-face restricting members 300 (a first end-face restricting member 310 and a second end-face restricting member 320, see FIG. 3).

The fusing belt 110 is of an endless belt (of a tubular configuration) having heat resistivity and flexibility. The fusing belt 110 has an inner peripheral surface that defines an internal space within which the halogen lamp 120, the nip plate 130, the reflection member 150, the stay 160 and the cover assembly 200 are disposed. The fusing belt 110 extends in a left-to-right direction. Hereinafter, the left-to-right direction in which the fusing belt 110 extends may also be referred to as an axial direction of the fusing belt 110, wherever necessary. The fusing belt 110 has widthwise end portions in the axial direction that are guided by inner guides 240 (described later) so that the fusing belt 110 is circularly movable. In the embodiment, a material of the fusing belt 110 is not specified. For example, the fusing belt 110 may be made from a metal, such as a stainless steel, or may be made from a resin, such as polyimide resin.

The halogen lamp 120 is a heater to generate radiant heat to heat the nip plate 130 and the fusing belt 110 for heating toner on the sheet S. The halogen lamp 120 is positioned at the internal space of the fusing belt 110 such that the halogen lamp 120 is spaced away from an inner surface of the nip plate 130 by a predetermined distance.

The nip plate 130 has a plate-like shape and is adapted to receive radiant heat from the halogen lamp 120. To this effect, the nip plate 130 is positioned at the internal space of the fusing belt 110 such that the inner peripheral surface of the fusing belt 110 is slidably movable with a lower surface of the nip plate 130. The nip plate 130 is made from a metal. In the embodiment, the nip plate 130 is made of aluminum having a thermal conductivity higher than that of the stay 160 (described later) made from a steel. For fabricating the nip plate 130, an aluminum plate is bent to provide a base portion 131, a first protruding portion 132, and two second protruding portions 133, as shown in FIG. 3.

The base portion 131 is flat and extends in the left-to-right direction. The base portion 131 has a lower surface that is in sliding contact with the inner peripheral surface of the fusing belt 110. The base portion 131 transmits the radiant heat from the halogen lamp 120 to the toner on the sheet S via the fusing belt 110.

The base portion 131 has a rear end portion from which the first protruding portion 132 and the two second protruding portions 133 protrude rearward respectively. Each of the first protruding portion 132 and the second protruding portions 133 has a substantially flat plate-like shape.

The first protruding portion 132 is formed at a position adjacent to a lateral center of the rear end portion of the base portion 131 in the left-to-right direction. The first protruding portion 132 has an upper surface on which the thermostat 170 is disposed to confront the same, and a lower surface that faces the backup roller 140.

The two second protruding portions 133 are formed such that one of the second protruding portions 133 is arranged at a position adjacent to a right end portion of the rear end portion of the base portion 131, while the other second protruding portion 133 is arranged at a position adjacent to the lateral center of the rear end portion but leftward of the first protruding portion 132 in the left-to-right direction. Each second protruding portion 133 has an upper surface on which one of the two thermistors 180 is disposed to face the same.

The backup roller 140 is disposed below the nip plate 130 such that the backup roller 140 nips the fusing belt 110 in cooperation with the nip plate 130, as shown in FIG. 2. In the present embodiment, the nip plate 130 and the backup roller 140 are biased toward each other so as to be in pressure contact with each other.

The backup roller 140 is configured to rotate upon receipt of a driving force transmitted from a motor (not shown) disposed within the main frame 2. As the backup roller 140 rotates, the fusing belt 110 is circularly moved along the nip plate 130 because of a friction force generated between the back-up roller 140 and the fusing belt 110 or between the sheet S and the fusing belt 110. The toner image on the sheet S can be thermally fixed thereto by heat and pressure during passage of the sheet S between the backup roller 140 and the fusing belt 110.

The reflection member 150 is adapted to reflect radiant heat from the halogen lamp 120 toward the nip plate 130. As shown in FIG. 2, the reflection member 150 is positioned at the internal space of fusing belt 110 to surround the halogen lamp 120 with a predetermined distance therefrom. Thus, heat from the halogen lamp 120 can be efficiently concentrated onto the nip plate 130 to promptly heat the nip plate 130 and the fusing belt 110.

The reflection member 150 has a U-shaped cross-section and is made from a material such as aluminum having high reflection ratio regarding infrared ray and far infrared ray. Specifically, the reflection member 150 has a U-shaped reflection portion 151 and two flange portions 152 each extending outward (frontward or rearward) from each end portion of the reflection portion 151 in a front-to-rear direction.

The stay 160 is adapted to support each end portion of the nip plate 130 in the front-to-rear direction. The stay 160 is disposed at the internal space of the fusing belt 110 so as to cover the halogen lamp 120 and the reflection member 150. For covering the reflection member 150 and the halogen lamp 120, the stay 160 has a U-shaped configuration in conformity with an outer profile of the U-shaped reflection member 150 (reflection portion 151). For fabricating the stay 160, a highly rigid member such as a steel plate is folded into U-shape to provide an upper wall (shown without a reference numeral), a front wall 161, and a rear wall 162.

More specifically, the stay 160 is disposed at a side opposite to the backup roller 140 with respect to the nip plate 130, as shown in FIG. 2. The front wall 161 has a bottom end portion that supports a front end portion of the nip plate 130 from upward thereof via the flange portion 152. The rear wall 162 has a bottom end portion that supports a rear end portion of the nip plate 130 from upward thereof via the flange portion 152. In other words, the nip plate 130 and the stay 160 nip the flange portions 152 of the reflection member 150 therebetween.

The stay 160 is adapted to receive a force applied to the nip plate 130 from the backup roller 140 and to support the nip plate 130. Here, the force applied to the nip plate 130 from the backup roller 140 refers to a biasing force of the backup roller 140.

On the upper wall of the stay 160, two fixing portions (shown without reference numerals) are formed. Specifically, the two fixing portions (right and left fixing portions) are formed at positions separated from each other in the left-to-right direction, and each fixing portion extends rearward from the upper wall of the stay 160. A screw hole 160A is formed on one of the fixing portions (the right fixing portion), while a screw hole 160B is formed at the other fixing portion (the left fixing portion). Screws 261, 262 are respectively screwed into the screw holes 160A, 160B, as shown in FIG. 3. The cover assembly 200 (described later) is thus threadingly fixed to the stay 160 by the screws 261, 262.

The thermostat 170 is configured to detect a temperature of the nip plate 130. The thermostat 170 has a lower surface serving as a temperature detecting surface. As shown in FIG. 2, the thermostat 170 is disposed at the internal space of the fusing belt 110 such that the lower surface of the thermostat 170 opposes the upper surface of the first protruding portion 132 of the nip plate 130. Further, the thermostat 170 is adapted to be fitted in a first positioning portion 211 (described later) formed on a first cover member 210 of the cover assembly 200. The thermostat 170 is thus positioned in the front-to-rear direction as well as in the left-to-right direction. The thermostat 170 is biased toward the first protruding portion 132 (toward the backup roller 140) by a coil spring 191. With this construction, the thermostat 170 is stably positioned relative to the nip plate 130. Hence, the thermostat 170 can detect the temperature of the nip plate 130 with accuracy.

The thermistors 180 are temperature sensors configured to detect the temperature of the nip plate 130. Each thermistor 180 has a lower surface serving as a temperature detecting surface. The two thermistors 180 are disposed at the internal space of the fusing belt 110 such that the lower surface of each thermistor 180 opposes the upper surface of each second protruding portion 133 of the nip plate 130.

Further, each thermistors 180 is adapted to be coupled to each second positioning portion 212 (described later) formed on the first cover member 210 of the cover assembly 200. The thermistors 180 are thus positioned in the front-to-rear direction as well as in the left-to-right direction. Each thermistor 180 is further biased toward each second protruding portion 133 (toward the backup roller 140) by a coil spring 192. With this construction, the thermistors 180 are stably positioned relative to the nip plate 130. The thermistors 180 can therefore detect the temperature of the nip plate 130 with accuracy.

The cover assembly 200 is adapted to support the thermostat 170, the thermistors 180 and the coil springs 191, 192. The cover assembly 200 is disposed at the internal space of the fusing belt 110 so as to cover the stay 160, as shown in FIG. 2.

The cover assembly 200 includes the first cover member 210 and a second cover member 220, as shown in FIG. 3.

The first cover member 210 extends in the left-to-right direction and has a substantially U-shaped cross-section to cover the stay 160. The first cover member 210 includes the first positioning portion 211, two second positioning portions 212, and a through-hole 210A. The first positioning portion 211 is formed on a rear wall of the first cover member 210 at a position substantially center in the left-to-right direction to position the thermostat 170. The two second positioning portions 212 are formed on the rear wall of the first cover member 210 at positions separate from each other in the left-to-right direction for positioning the thermistors 180. Specifically, the first positioning portion 211 is interposed between the two second positioning portions 212 in the left-to-right direction, as shown in FIG. 3. The through-hole 210A is formed on an upper wall of the first cover member 210 for allowing the screw 261 to penetrate therethrough.

As shown in FIGS. 2 and 3, the second cover member 220 has a substantially L-shaped cross-section and extends in the left-to-right direction. The second cover member 220 has an upper wall on which three supporting portions 221 (only one is shown in FIG. 3), a circular hole 220A and an oblong hole 220B are formed. Specifically, each supporting portion 221 has a boss-like shape protruding downward from a lower surface of the upper wall of the second cover member 220 for supporting one of the coil springs 191, 192. The circular hole 220A is formed at a right end portion of the upper wall of the second cover member 220, and the oblong hole 220B is formed at a left end portion of the second cover member 220. The screws 261, 262 are respectively inserted into the circular hole 220A and the oblong hole 220B.

For fixing the cover assembly 200 to the stay 160, the screw 261 is inserted into the circular hole 220A and the through-hole 210A such so that the screw 261 can be screwed into the screw hole 160A of the stay 160. The screw 262 is screwed into the screw hole 160B via the oblong hole 220B. In this way, the cover assembly 200 supports the stay 160, and also supports the nip plate 130 via the stay 160.

The cover assembly 200 has left and right end portions on each of whose outer surface the inner guide 240 and a mounting portion 250 are formed, as shown in FIGS. 4 and 5. The inner guides 240 are adapted to be in sliding contact with the inner peripheral surface of the fusing belt 110 to guide the circular movement of the fusing belt 110 (also see FIG. 2). Each mounting portion 250 is arranged outward (rightward or leftward) of the corresponding inner guide 240 in the left-to-right direction. Each mounting portion 250 is adapted to be engaged with each end-face restricting member 300 (the first end-face restricting member 310 or the second end-face restricting member 320).

Referring to FIG. 4A through 5B, each inner guide 240 includes a first inner guide 241 formed on the first cover member 210 and a second inner guide 242 formed on the second cover member 220 (also see FIG. 3).

The first inner guide 241 serves to guide a portion of the inner peripheral surface of the fusing belt 110, the portion being positioned frontward of the cover assembly 200 while the fusing belt 110 is circularly moved (see FIG. 2). Each first inner guide 241 is formed on each widthwise end portion of the first cover member 210 (right and left end portions of the first cover member 210) such that each first inner guide 241 projects frontward from a front wall of the first cover member 210.

The second inner guide 242 serves to guide a portion of the inner peripheral surface of the fusing belt 110, the portion being positioned upward of the cover assembly 200 while the fusing belt 110 is circularly moved (see FIG. 2). Each second inner guide 242 is formed on each widthwise end portion of the second cover member 220 (left and right end portions of the second cover member 220) such that each second inner guide 242 projects upward from the upper wall of the second cover member 220.

Due to the first inner guides 241 and the second inner guides 242 formed on the cover assembly 200, the circular movement of the fusing belt 110 can be stably guided at positions frontward and upward of the cover assembly 200.

Each mounting portions 250 is formed on each widthwise end portion of the cover assembly 200 in the left-to-right direction. Specifically, the mounting portion 250 formed on the right end portion of the cover assembly 200 includes a first guide groove 251 and two first engaged portions 252, whereas the mounting portion 250 formed on the left end portion of the cover assembly 200 includes a second guide groove 253 and two second engaged portions 254.

Figure 4A:
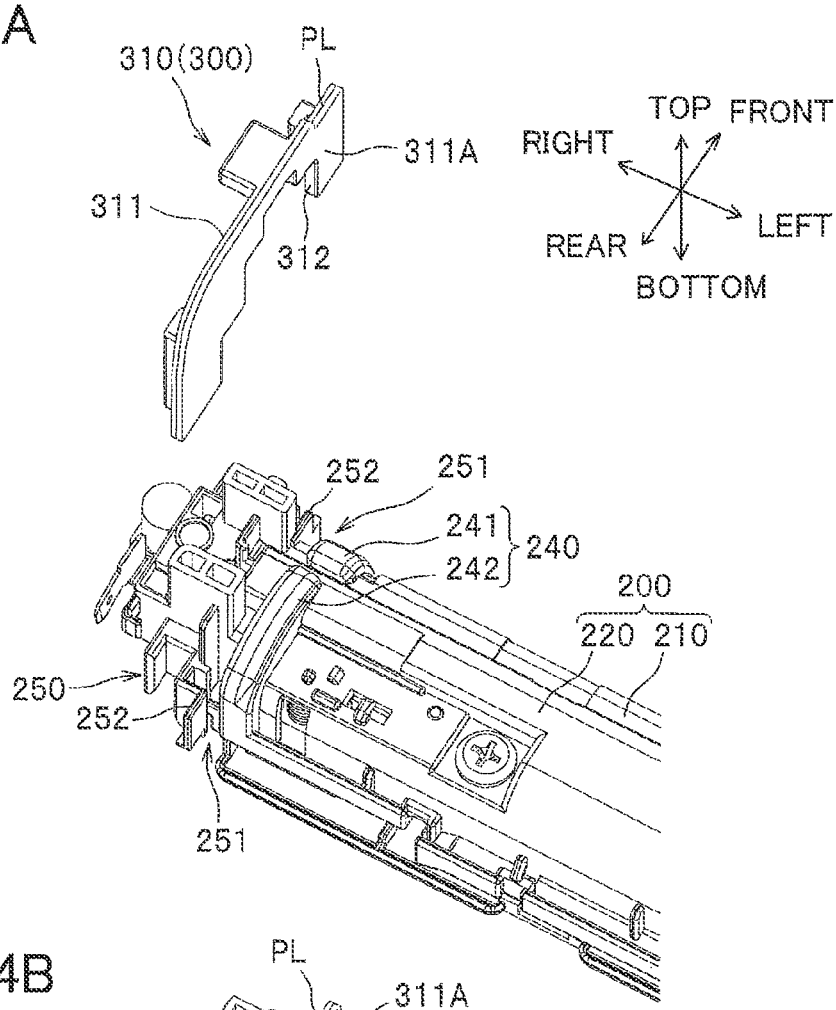
FIG. 4A is an enlarged perspective view of a right end portion of the fixing device according to the embodiment, wherein the first end-face restricting member is detached from the cover assembly.
Figure 4B:
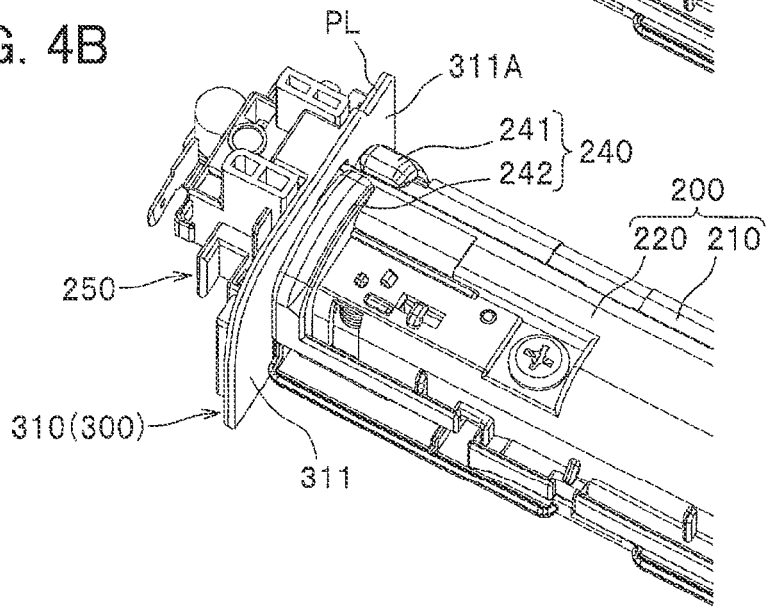
FIG. 4B is an enlarged perspective view of the right end portion of the fixing device according to the embodiment, wherein the first end-face restricting member is assembled to the cover assembly.

Referring to FIGS. 4A and 4B, the first guide groove 251 is a groove extending in the front-to-rear direction for receiving the first end-face restricting member 310. The first guide groove 251 is formed at the right end portion of the cover assembly 200. Specifically, the first guide groove 251 is a gap formed between the inner guide 240 and the first engaged portions 252 positioned rightward of the first guide groove 251 in the left-to-right direction. The first guide groove 251 has a depth in a top-to-bottom direction, i.e., extends on front and rear end portions of the cover assembly 200. The first guide groove 251 has a width in the left-to-right direction that is substantially identical to that of a first restricting plate 311 (described later) of the first end-face restricting member 310. In other words, the first guide groove 251 extends in a direction identical to a direction in which the first end-face restricting member 310 is assembled to the cover assembly 200.

The two first engaged portions 252 are flat plates positioned rightward of the inner guide 240 and adapted to be engaged with hook portions 313 (see FIG. 6A) of the first end-face restricting member 310. One of the first engaged portions 252 extending frontward from the front wall of the first cover member 210, while the other first engaged portion 252 extends rearward from the rear wall of the first cover member 210. The first engaged portions 252 constitute a right end wall of the first guide groove 251.

Figure 5A:
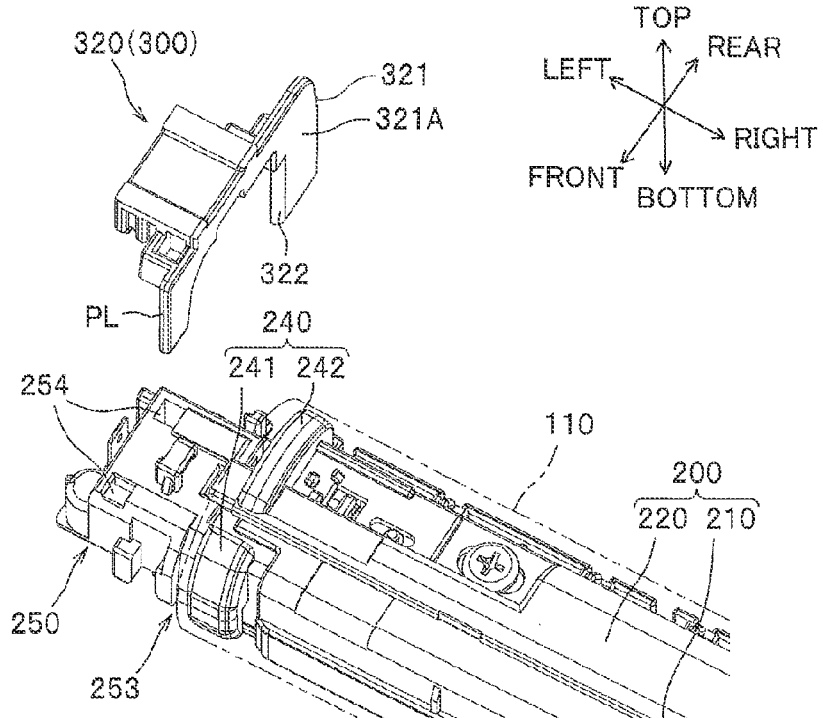
FIG. 5A is an enlarged perspective view of a left end portion of the fixing device according to the embodiment, wherein the second end-face restricting member is detached from the cover assembly.
Figure 5B:
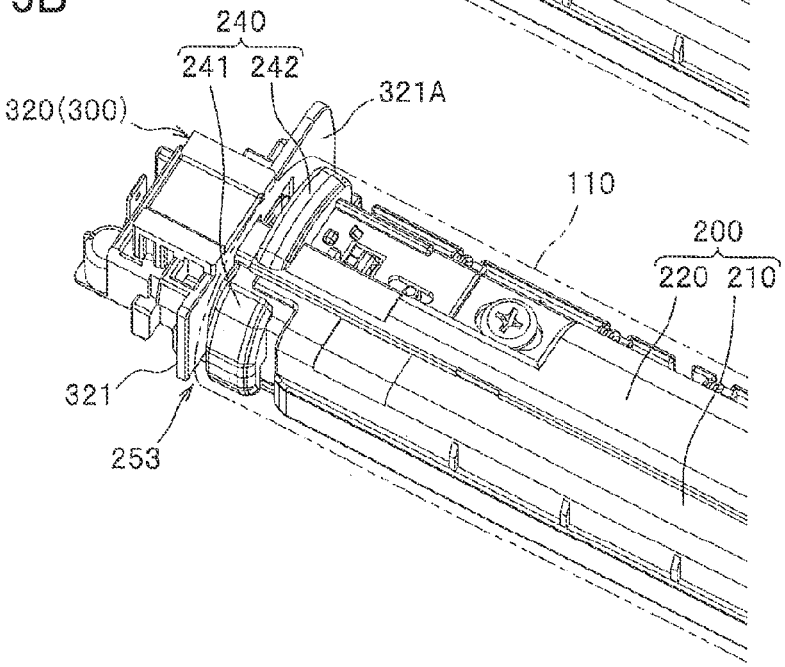
FIG. 5B is an enlarged perspective view of the left end portion of the fixing device according to the embodiment, wherein the second end-face restricting member is assembled to the cover assembly.

Referring to FIGS. 5A and 5B, the second guide groove 253 is a groove extending in the front-to-rear direction. For receiving the second end-face restricting member 320, the second guide groove 253 has a depth in the top-to-bottom direction, i.e., extends in a direction identical to a direction in which the second end-face restricting member 320 is assembled to the cover assembly 200, just like the first guide groove 251. The second guide groove 253 is formed at the left end portion of the cover assembly 200 such that the second guide groove 253 is positioned immediately leftward of the inner guide 240. The second guide groove 253 has a width in the left-to-right direction that is larger than that of the second end-face restricting member 320. Hence, when assembled, the second end-face restricting member 320 is located at a position outward of and separate from the inner guide 240 in the left-to-right direction, i.e., a gap is formed between the second end-face restricting member 320 and the inner guide 240. As a result, even if thermal expansion causes the inner guide 240 to deform (even if the position of the inner guide 240 may change in the axial direction), this gap between the second end-face restricting member 320 and the inner guide 240 can absorb the change in position of the inner guide 240.

The second engaged portions 254 are recessed portions formed on the upper wall of the first cover member 210. The second engaged portions 254 oppose each other in the front-to-rear direction and are positioned outward (leftward) of the second guide groove 253 in the left-to-right direction. The second engaged portion 254 are adapted to receive protruding portions 323 (described later) of the second end-face restricting member 320.

The cover assembly 200 is formed by injection molding with a resin. Dies (metal molds) are opened in a direction parallel to a direction in which the nip plate 130 and the back-up roller 140 confront with each other, i.e., in the top-to-bottom direction. Due to the injection molding, the outer surface of the cover assembly 200 is formed with parting lines PL. In the present embodiment, as shown in FIGS. 2 and 3, these parting lines PL are formed on front and rear surfaces of the cover assembly 200 at portions other than outer surfaces of the inner guides 240 which are in sliding contact with the inner peripheral surface of the fusing belt 110. It should be noted that, since the fusing belt 110 slidingly contacts the nip plate 130, the fusing belt 110 inevitably becomes flat in the top-to-bottom direction while the fusing belt 110 is circularly moved. This means that the inner peripheral surface of the fusing belt 110 does not in contact with entirety of the front and rear surfaces of the cover assembly 200. In other words, some portions of the front and rear surfaces of the cover assembly 200 stay away from the inner peripheral surface of the fusing belt 110. Since the parting lines PL of the present embodiment are formed on these portions of the front and rear surfaces that do not slidingly contact the inner peripheral surface of the fusing belt 110, damages to the fusing belt 110 attributed to sliding contact between the fusing belt 110 and the parting lines PL can be prevented.

The pair of end-face restricting members 300 serves to position the fusing belt 110 in the axial direction. The end-face restricting members 300 include the first end-face restricting member 310 for restricting a right end face of the fusing belt 110, and the second end-face restricting member 320 for restricting a left end face of the fusing belt 110.

Figure 6A:
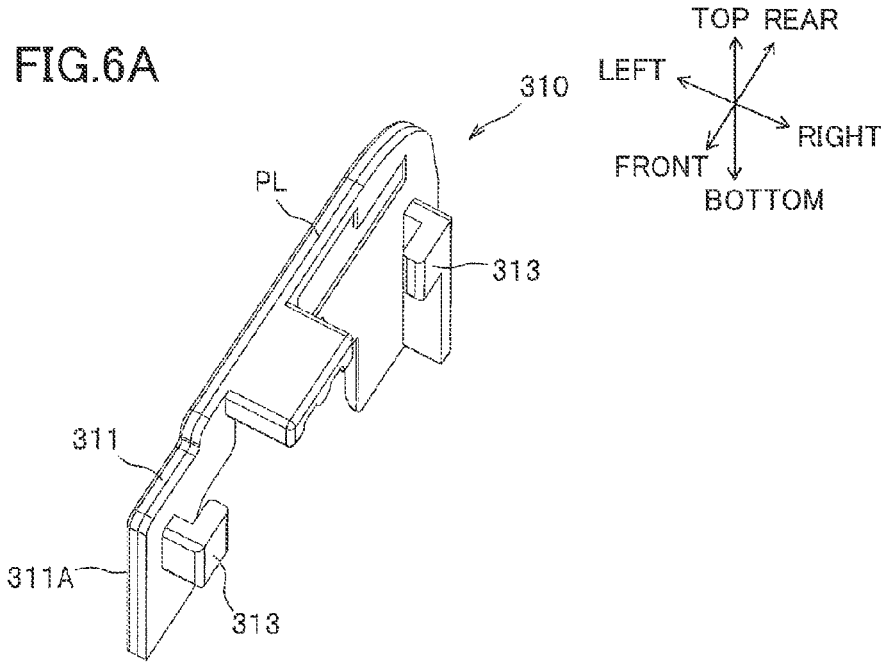
FIG. 6A is a perspective view of the first end-face restricting member.

As shown in FIGS. 4A, 4B and 6A, the first end-face restricting member 310 includes the first restricting plate 311 and the hook portions 313.

The first restricting plate 311 is fitted with the first guide groove 251 of the mounting portion 250 provided on the right end portion of the cover assembly 200. The first restricting plate 311 has a left surface 311A that is abuttable with the right end face of the fusing belt 110. This left surface 311A serves as a first restricting surface 311A for restricting the fusing belt 110 (the right end face of the fusing belt 110) from moving rightward in the axial direction.

The first restricting surface 311A has a height higher than that of the cover assembly 200 in the top-to-bottom direction. More specifically, as shown in FIG. 2, when assembled to the cover assembly 200, the first restricting surface 311A extends from a position in the vicinity of the nip plate 130 up to a position upward of the second inner guide 242 in the top-to-bottom direction. In other words, the first restricting surface 311A has at least a portion that is positioned to superpose with a portion of the fusing belt 110 (to be referred to as a remote portion) in the axial direction, the remote portion being opposite to a portion of the fusing belt 110 nipped between the nip plate 130 and the backup roller 140 (to be referred to as a nipped portion). With this construction, the first restricting surface 311A can reliably restrict an upper portion of the fusing belt 110 (i.e., the remote portion) from moving in the axial direction.

Preferably, the first restricting surface 311A extend in a direction perpendicular to the axial direction (i.e., in the top-to-bottom direction in the present embodiment). However, the first restricting surface 311A may be slanted relative to the direction perpendicular to the axial direction by an angle between 0 to 5 degrees.

The first restricting surface 311A has a lower end portion on which a cutout 312 is formed. The cutout 312 has a shape whose outer profile is in conformance with that of the first guide groove 251. Hence, an edge portion of the cutout 312 is engaged with the first guide groove 251 when the first restricting plate 311 is coupled to the first guide groove 251.

Referring to FIG. 6A, the two hook portions 313 are formed on a right surface of the first restricting plate 311. Each hook portion 313 has a substantially L-shape, protruding inward from each end portion of the right surface of the first restricting wall 311 in the front-to-rear direction. Specifically, one of the hook portions 313 protrudes rightward from a front end portion of the right surface and has a tip end portion extending rearward. Remaining one of the hook portions 313 protrudes rightward from a rear end portion of the right surface of the first restricting plate 311 and has a tip end portion extending frontward. The hook portions 313 are respectively engaged with the first engaged portions 252 such that the tip end portions of the hook portions 313 are positioned rightward of the first engaged portions 252 in the left-to-right direction.

Figure 6B:
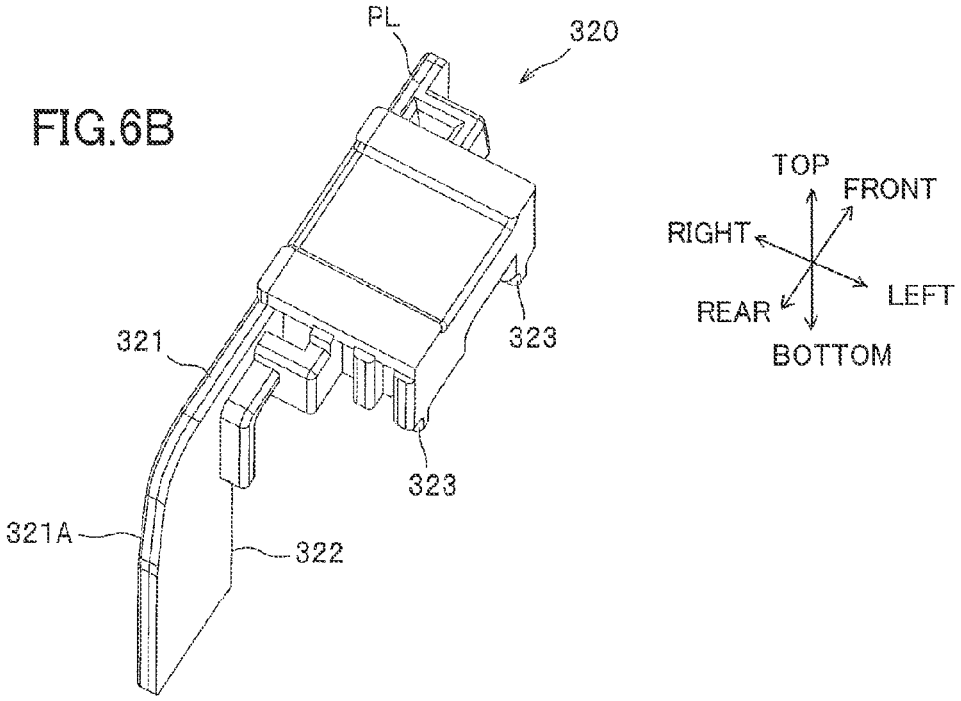
FIG. 6B is a perspective view of the second end-face restricting member.

Referring to FIG. 6B, the second end-face restricting member 320 includes a second restricting plate 321, and two protruding portions 323.

The second restricting plate 321 is fitted with the second guide groove 253 of the mounting portion 250 formed on the left end portion of the cover assembly 200. The second restricting plate 321 has a right surface 321A that is abuttable with the left end face of the fusing belt 110. This right surface 321A serves as a second restricting surface 321A adapted to restrict the fusing belt 110 from moving leftward in the axial direction.

The second restricting surface 321A has a height higher than that of the cover assembly 200 in the top-to-bottom direction. More specifically, as shown in FIGS. 5A and 5B, when assembled to the cover assembly 200, the second restricting surface 321A extends from a position in the vicinity of the nip plate 130 up to a position upward of the second inner guide 242 in the top-to-bottom direction. In other words, the second restricting surface 321A has at least a portion that is positioned to superpose with the remote portion of the fusing belt 110 opposite to the nipped portion in the axial direction. With this construction, the second restricting surface 321A can reliably restrict the upper portion of the fusing belt 110 (i.e., the remote portion) from moving in the axial direction.

Preferably, just like the first restricting surface 311A, the second restricting surface 321A also extend in the direction perpendicular to the axial direction (in the top-to-bottom direction in the embodiment). However, the second restricting surface 321A may be slanted relative to the direction perpendicular to the axial direction by an angle between 0 to 5 degrees.

The second restricting surface 321A has a lower end portion on which a cutout 322 is formed. The cutout 322 has a shape whose outer profile is in conformance with that of the second guide groove 253. Hence, an edge portion of the cutout 322 is engaged with the second guide groove 253 when the second restricting plate 321 is fitted with the second guide groove 253.

The second restricting plate 321 has a left surface from which an extending section (shown without reference numeral in FIG. 6B) protrudes leftward. The extending section has a lower surface that opposes an upper surface of the mounting portion 250 in the top-to-bottom direction. From the lower surface of the extending section, the two protruding portions 323 protrude downward. Specifically, the protruding portions 323 are formed on a left end portion of the lower surface at positions opposing to each other in the front-to-rear direction. The position of each protruding portion 323 corresponds to the position of each second coupled portion 254 of the mounting portion 250 formed on the left end portion of the cover assembly 200 such that each protruding portion 323 is coupled to each second engaged portion 254, as shown in FIGS. 5A and 5B. Due to this engagement between the protruding portions 323 and the second engaged portions 254, the second end-face restricting member 320 is stably positioned relative to the mounting portion 250.

The pair of end-face restricting members 300 (the first end-face restricting member 310 and the second end-face restricting member 320) is also formed by injection molding with a resin. Dies (metal molds) are opened in a direction parallel to the axial direction (i.e., the left-to-right direction). Hence, as shown in FIGS. 6A and 6B, parting lines PL as a result of the injection molding are not formed on the first restricting surface 311A nor on the second restricting surface 321A, both of which are abuttable with the end surfaces of the fusing belt 110, but formed on surfaces extending in a direction perpendicular to the direction in which the first restricting surface 311A and the second restricting surface 321A extend. In other words, the parting lines PL are formed on surfaces extending in a direction coincident with the axial direction. Therefore, the parting lines PL formed on the first end-face restricting member 310 and the second end-face restricting member 320 do not damage the end faces of the fusing belt 110.

For assembling the end-face restricting members 300 to the cover assembly 200, the first end-face restricting member 310 is placed above the cover assembly 200 and moved downward such that the first end-face restricting member 310 is coupled into the first guide groove 251 extending in the top-to-bottom direction (the direction in which the first end-face restricting member 310 is assembled to the cover assembly 200). At this time, the hook portions 313 of the first end-face restricting member 310 are engaged with the first engaged portions 252 of the mounting portion 250 formed on the right end portion of the cover assembly 200.

Then, the fusing belt 110 is mounted over the cover assembly 200 by inserting the left end portion of the cover assembly 200 into the internal space of the fusing belt 110. The second end-face restricting member 320 is then placed above the cover assembly 200 and moved downward such that the second end-face restricting member 320 is coupled to the second guide groove 253 extending in the top-to-bottom direction (the direction in which the second end-face restricting member 320 is assembled to the cover assembly 200) so as not to cause interference between the second end-face restricting member 320 and the left end portion of the fusing belt 110. At this time, the protruding portions 323 of the second end-face restricting member 320 are fitted into the second engaged portions 254 of the mounting portion 250 formed on the left end portion of the cover assembly 200. In this way, by assembling the end-face restricting members 300 to the cover assembly 200, the end-face restricting members 300 (the first end-face restricting member 310 and the second end-face restricting member 320) are assembled to the stay 160 via the cover assembly 200.

As described above, the end-face restricting members 300 for restricting the position of the fusing belt 110 in the axial direction are formed as members separate from the inner guides 240. Further, the end-face restricting members 300 are assembled to the stay 160 in a direction perpendicular to the axial direction. Therefore, after the fusing belt 110 is mounted on the cover assembly 200 and positioned relative to the inner guides 240 formed on the cover assembly 200, the end-face restricting members 300 are assembled to the cover assembly 200 while referring to the position of the end face of the fusing belt 110 which has already been mounted on the cover assembly 200. In this way, the end faces of the fusing belt 110 are less likely to be damaged during assembly, compared to a case where the end-face restricting members 300 are assembled to the stay 160 in the axial direction.

Further, since the inner guides 240 are formed on the outer surface of the cover assembly 200 in the embodiment, a reduced number of parts are required to constitute the fixing device 100, compared to a case where the inner guides 240 are formed as members separate from the cover assembly 200.

Further, the second end-face restricting member 320 is positioned outward of the corresponding inner guide 240 in the axial direction such that the second end-face restricting member 320 is spaced away from the inner guide 240. Hence, even if the inner guide 240 is displaced due to thermal expansion, the displacement of the inner guide 240 can be absorbed at the gap formed between the second end-face restricting member 320 and the inner guide 240.

Further, in the embodiment, assembly of the end-face restricting members 300 to the cover assembly 200 can be facilitated since the first guide groove 251 and the second guide groove 253 formed on the cover assembly 200 serve to guide the assembly of the first end-face restricting member 310 and the second end-face restricting member 320 to the cover assembly 200. Since the first guide groove 251 and the second guide groove 253 are grooves, a user can intuitively recognize where to assemble the end-face restricting members 300 with ease.

Further, the first end-face restricting member 310 is formed with the hook portions 313 engageable with the first engaged portions 252 and the second end-face restricting member 320 is formed with the protruding portions 323 engageable with the second engaged portions 254 formed on the cover assembly 200. In other words, each end-face restricting member 300 is supported to the cover assembly 200 at two points: the first end-face restricting member 310 is engaged with the cover assembly 200 by engagements between the first restricting wall 311 and the first guide groove 251 and between the hook portions 313 and the first engaged portions 252; and the second end-face restricting member 320 is supported to the cover assembly 200 by engagements between the second restricting plate 321 and the second guide groove 253 and between the protruding portions 323 and the second engaged portions 254. The end-face restricting members 300 are thus securely supported to the cover assembly 200.

Further, the end-face restricting members 300 are formed by injection molding with a resin. Dies (metal molds) used for molding of the end-face restricting members 300 are opened in a direction coincident with the axial direction. In other words, the parting lines PL on the end-face restricting members 300 are formed on surfaces which the end faces of the fusing belt 110 do not contact. Therefore, the end faces of the fusing belt 110 can be prevented from being damaged by the parting lines PL formed on the end-face restricting members 300.

Further, the inner guides 240 are formed by injection molding with a resin. The direction in which the dies (metal molds) are opened (die opening direction) is coincident with the direction in which the nip plate 130 and the back-up roller 140 confront with each other (top-to-bottom direction). That is, the parting lines PL on the cover assembly 200 are formed on surfaces with which the inner peripheral surface of the fusing belt 110 is not in contact. The inner peripheral surface of the fusing belt 110 can be thus prevented from being damaged by the parting lines PL formed on the cover assembly 200.

Further, each of the first restricting surface 311A of the first end-face restricting member 310 and the second restricting surface 321A of the second end-face restricting member 320 has at least a portion that is positioned to superpose with the remote portion of the fusing belt 110 in the axial direction, the remote portion being opposite to the nipped portion of the fusing belt 110 that is nipped between the nip plate 130 and the backup roller 140. With this construction, end faces of the upper portion (remote portion) of the fusing belt 110, which need to be restricted to facilitate the circular movement of the fusing belt 110, can be reliably restricted from moving in the axial direction by the first restricting surface 311A and the second restricting surface 321A.

Various changes and modifications are conceivable.

For example, in the depicted embodiment, both of the first end-face restricting member 310 and the second end-face restricting member 320 are provided separately from the respective inner guides 240. However, either one of the first end-face restricting member 310 and the second end-face restricting member 320 may be integrally formed with one of the inner guides 240, and remaining one of the first end-face restricting member 310 and the second end-face restricting member 320 may be formed separately from the remaining one of the inner guides 240.

In the depicted embodiment, the first end-face restricting member 310 and the second end-face restricting member 320 are respectively assembled to the stay 160 in the direction perpendicular to the axial direction. However, the first end-face restricting member 310 may be assembled in a direction parallel to the axial direction, whereas the second end-face restricting member 320 is assembled to the direction perpendicular to the axial direction as in the embodiment. Under this configuration, damages to the end faces of the fusing belt 110 can also be prevented if the first end-face restricting member 310 is assembled to the cover assembly 200 before the fusing belt 110 is mounted on the cover assembly 200.

Further, each end-face restricting member 300 is not necessarily assembled to the stay 160 via the cover assembly 200. Instead, each end-face restricting member 300 may be assembled directly to the stay 160. For example, each end-face restricting members 300 may be assembled to portions of the stay 160 that are exposed from the first guide groove 251 and the second guide groove 253.

Instead of the backup roller 140, a belt-like pressure member is also available as the backup member.

Further, instead of the halogen lamp 120, a carbon heater or an IH heater may also be available as the heater.

Further, the sheet S can be an OHP sheet instead of a plain paper and a postcard.

Further, in the depicted embodiment, the present invention is applied to the monochromatic laser printer 1 as an example of an image forming apparatus. However, the present invention may also be applicable to a color laser printer, and other image forming apparatuses such as a copying machine and a multifunction device provided with an image scanning device such as a flat head scanner.

While the invention has been described in detail with reference to the embodiments thereof, it would be apparent to those skilled in the art that various changes and modifications may be made therein without departing from the spirit of the invention.

What is claimed is:

1. A fixing device for thermally fixing a developing agent image to a sheet comprising:

a flexible tubular member having an inner peripheral surface defining an internal space, the flexible tubular member being circularly movable while the developing agent image is thermally fixed, the flexible tubular member defining an axis extending in an axial direction and having end portions in the axial direction;

a heater disposed in the internal space;

a nip member disposed in the internal space and configured to be in sliding contact with the inner peripheral surface of the flexible tubular member;

a backup member disposed to confront the nip member to nip the flexible tubular member in cooperation with the nip member;

a stay disposed in the internal space to support the nip member;

a pair of inner guides configured to be in sliding contact with the inner peripheral surface of the flexible tubular member to guide the inner peripheral surface of the flexible tubular member while the flexible tubular member circularly moves; and a pair of restricting members configured to restrict the end portions of the flexible tubular member from moving in the axial direction, at least one of the pair of restricting members being formed separately from the inner guides and being assembled to the stay in a first direction perpendicular to the axial direction, wherein the pair of restricting members is formed by injection molding with a resin in which a die opening direction is coincident with the axial direction.

2. The fixing device as claimed in claim 1, further comprising a cover extending through the internal space for covering at least a portion of the stay, the cover having an outer surface on which the pair of inner guides is formed.

3. The fixing device as claimed in claim 2, wherein the cover has an end portion in the axial direction, at least one of the inner guides being formed on the end portion of the cover.

4. The fixing device as claimed in claim 2, wherein the cover is formed with a guide portion extending in a direction substantially parallel to the first direction and configured to be engaged with the at least one of the restricting members, the at least one of the restricting members being assembled to the cover by being inserted into and engaged with the guide portion in the first direction.

5. The fixing device as claimed in claim 4, wherein the guide portion is in a form of a groove.

6. The fixing device as claimed in claim 4, wherein the cover is further formed with an engaged portion positioned outward of the guide portion in the axial direction; and wherein the at least one of the restricting members is formed with an engaging portion configured to be engaged with the engaged portion when assembled to the cover.

7. The fixing device as claimed in claim 1, wherein each restricting member is provided for a corresponding inner guide, at least one of the restricting members being positioned outward of and separated from the corresponding inner guide in the axial direction.

8. A fixing device comprising:

a flexible tubular member;

a heater extending through an internal space of the flexible tubular member;

a nip member contactable with an inner peripheral surface of the flexible tubular member;

a backup member, the nip member and the backup member being configured to nip the flexible tubular member therebetween;

a stay extending through the internal space of the flexible tubular member;

an inner guide for guiding an end portion, in an axial direction of the flexible tubular member, of the inner peripheral surface of the flexible tubular member; and a restricting member configured to be in contact with an edge, in the axial direction, of the flexible tubular member, the restricting member being separated from the inner guide and being assembled to the stay in a first direction substantially perpendicular to the axial direction, wherein the restricting member is formed by injection molding with a resin in which a die opening direction is substantially coincident with the axial direction.

9. The fixing device as claimed in claim 8, further comprising a cover extending through the internal space of the flexible tubular member, the cover having a guide portion for guiding the restricting member.

10. The fixing device as claimed in claim 9, wherein the inner guide is formed on the cover.

11. The fixing device as claimed in claim 10, wherein the restricting member is formed with a cutout, the cutout being configured to be engaged with the guide portion of the cover.

12. The fixing device as claimed in claim 11, wherein the cutout of the restricting member is open in a direction perpendicular to the axial direction.

13. The fixing device as claimed in claim 9, wherein the guide portion has a groove.

14. The fixing device as claimed in claim 13, wherein the groove extends in a direction perpendicular to the axial direction.

15. A fixing device comprising:

a flexible tubular member;

a heater extending through an internal space of the flexible tubular member;

a nip member contactable with an inner peripheral surface of the flexible tubular member;

a backup member, the nip member and the backup member being configured to nip the flexible tubular member therebetween and opposing each other in a second direction;

a stay extending through the internal space of the flexible tubular member;

an inner guide for guiding an end portion, in an axial direction of the flexible tubular member, of the inner peripheral surface of the flexible tubular member; and a restricting member configured to be in contact with an edge, in the axial direction, of the flexible tubular member, the restricting member being separated from the inner guide and being assembled to the stay in a first direction substantially perpendicular to the axial direction, wherein the inner guide is formed by injection molding with a resin in which a die opening direction is coincident with the second direction.

16. The fixing device as claimed in claim 15, further comprising a cover extending through the internal space of the flexible tubular member, the cover having a guide portion for guiding the restricting member.

17. The fixing device as claimed in claim 16, wherein the inner guide is formed on the cover.

18. The fixing device as claimed in claim 17, wherein the restricting member has a cutout, the cutout being configured to be engaged with the guide portion of the cover.

19. The fixing device as claimed in claim 18, wherein the cutout of the restricting member is open in a direction perpendicular to the axial direction.

20. The fixing device as claimed in claim 16, wherein the guide portion has a groove.

21. The fixing device as claimed in claim 20, wherein the groove extends in a direction perpendicular to the axial direction.

* * * * *